US011133015B2

(12) United States Patent
Beack et al.

(10) Patent No.: US 11,133,015 B2
(45) Date of Patent: Sep. 28, 2021

(54) METHOD AND DEVICE FOR PREDICTING CHANNEL PARAMETER OF AUDIO SIGNAL

(71) Applicant: Electronics and Telecommunications Research Institute, Daejeon (KR)

(72) Inventors: Seung Kwon Beack, Daejeon (KR); Woo-taek Lim, Daejeon (KR); Jongmo Sung, Daejeon (KR); Mi Suk Lee, Daejeon (KR); Tae Jin Lee, Daejeon (KR); Hui Yong Kim, Daejeon (KR)

(73) Assignee: Electronics and Telecommunications Research Institute, Daejeon (KR)

( * ) Notice: Subject to any disclaimer, the term of this patent is extended or adjusted under 35 U.S.C. 154(b) by 508 days.

(21) Appl. No.: 16/180,298

(22) Filed: Nov. 5, 2018

(65) Prior Publication Data

US 2019/0180763 A1 Jun. 13, 2019

(30) Foreign Application Priority Data

Dec. 11, 2017 (KR) ..... 10-2017-0169652

(51) Int. Cl.
*G10L 19/04* (2013.01)
*G10L 25/30* (2013.01)
*G10L 19/008* (2013.01)

(52) U.S. Cl.
CPC ..... *G10L 19/04* (2013.01); *G10L 19/008* (2013.01); *G10L 25/30* (2013.01)

(58) Field of Classification Search
CPC ..... G10L 19/04; G10L 19/008; G10L 25/30
USPC ..... 704/500
See application file for complete search history.

(56) References Cited

U.S. PATENT DOCUMENTS

2011/0166867 A1 7/2011 Seo et al.
2015/0317991 A1 11/2015 Liu et al.
2016/0247516 A1 8/2016 Schmidt et al.
2017/0134873 A1 5/2017 Beack et al.

OTHER PUBLICATIONS

Breebaart, Jeroen, et al., "MPEG Spatial Audio Coding/MPEG Surround: Overview and Current Status," *Preprint 110th Conv. Audio Engineering Society*, New York, New York USA Oct. 7-10, 2005 (17 pages in English).

*Primary Examiner* — Thierry L Pham
(74) *Attorney, Agent, or Firm* — NSIP Law

(57) ABSTRACT

A method of predicting a channel parameter of an original signal from a downmix signal is disclosed. The method may include generating an input feature map to be used to predict a channel parameter of the original signal based on a downmix signal of an original signal, determining an output feature map including a predicted parameter to be used to predict the channel parameter by applying the input feature map to a neural network, generating a label map including information associated with the channel parameter of the original signal, and predicting the channel parameter of the original signal by comparing the output feature map and the label map.

12 Claims, 5 Drawing Sheets

METHOD AND DEVICE FOR PREDICTING CHANNEL PARAMETER OF AUDIO SIGNAL

CROSS-REFERENCE TO RELATED APPLICATIONS

This application claims the benefit under 35 USC § 119(a) of Korean Patent Application No. 10-2017-0169652 filed on Dec. 11, 2017, in the Korean Intellectual Property Office, the entire disclosure of which is incorporated herein by reference for all purposes.

BACKGROUND

1. Field

The following description relates to a method and device to predict a channel parameter of an audio signal, and more particularly, to a method and device for applying a neural network to a feature map generated from a downmix signal and applying a channel parameter of an original signal.

2. Description of Related Art

The development of the Internet and the popularity of pop music have led to a more common practice of the transmission of audio files among users, and accordingly audio coding technology used to compress and transmit an audio signal has made great strides. However, existing technology may have a limited compression performance due to a structural restriction in audio signal conversion or a quality issue of an audio signal. Thus, there is a desire for new technology that may improve a compression performance while maintaining a quality of an audio signal.

SUMMARY

This Summary is provided to introduce a selection of concepts in a simplified form that are further described below in the Detailed Description. This Summary is not intended to identify key features or essential features of the claimed subject matter, nor is it intended to be used as an aid in determining the scope of the claimed subject matter.

According to example embodiments, there is provided a method and apparatus that may predict a channel parameter of an original signal from a downmix signal through a machine learning-based algorithm to improve a compression performance while maintaining a quality of an audio signal.

In one general aspect, a method of predicting a channel parameter of an original signal from a downmix signal, the method includes generating an input feature map used to predict a channel parameter of the original signal based on a downmix signal of an original signal, determining an output feature map including a predicted parameter used to predict the channel parameter by applying the input feature map to a neural network, generating a label map including information associated with the channel parameter of the original signal, and predicting the channel parameter of the original signal by comparing the output feature map and the label map.

The generating of the input feature map may include transforming the downmix signal into a frequency-domain signal, classifying the transformed downmix signal into a plurality of sub-groups, and determining a feature value corresponding to each of channels of the downmix signal or a combination of the channels for each of the sub-groups of the downmix signal.

The combination of the channels may be based on one of a summation, a differential, and a correlation of the channels.

The generating of the label map may include transforming the original signal into a frequency-domain signal, classifying the transformed original signal into a plurality of sub-groups, and determining a channel parameter corresponding to a combination of channels of the original signal for each of the sub-groups.

The determining of the output feature map may include inputting the input feature map to the neural network, and normalizing the input feature map processed through the neural network based on a quantization level of the label map.

The output feature map may include a predicted parameter corresponding to each of the channels of the downmix signal or a combination of the channels.

In another general aspect, a device for predicting a channel parameter of an original signal from a downmix signal, the device includes a processor. The processor may be configured to generate an input feature map to be used to predict a channel parameter of the original signal based on a downmix signal of an original signal, determine an output feature map including a predicted parameter to be used to predict the channel parameter by applying the input feature map to a neural network, generate a label map including information associated with the channel parameter of the original signal, and predict the channel parameter of the original signal by comparing the output feature map and the label map.

The processor may be further configured to transform the downmix signal into a frequency-domain signal, classify the transformed downmix signal into a plurality of sub-groups, and determine a feature value corresponding to each of channels of the downmix signal or a combination of the channels for each of the sub-groups of the downmix signal.

The combination of the channels may be based on one of a summation, a differential, and a correlation of the channels.

The processor may be further configured to transform the original signal into a frequency-domain signal, classify the transformed original signal into a plurality of sub-groups, and determine a channel parameter corresponding to a combination of channels of the original signal for each of the sub-groups.

The processor may be further configured to input the input feature map to the neural network, and normalize the input feature map processed through the neural network based on a quantization level of the label map.

The output feature map may include a predicted parameter corresponding to each of the channels of the downmix signal or a combination of the channels.

Other features and aspects will be apparent from the following detailed description, the drawings, and the claims.

Figure 1:
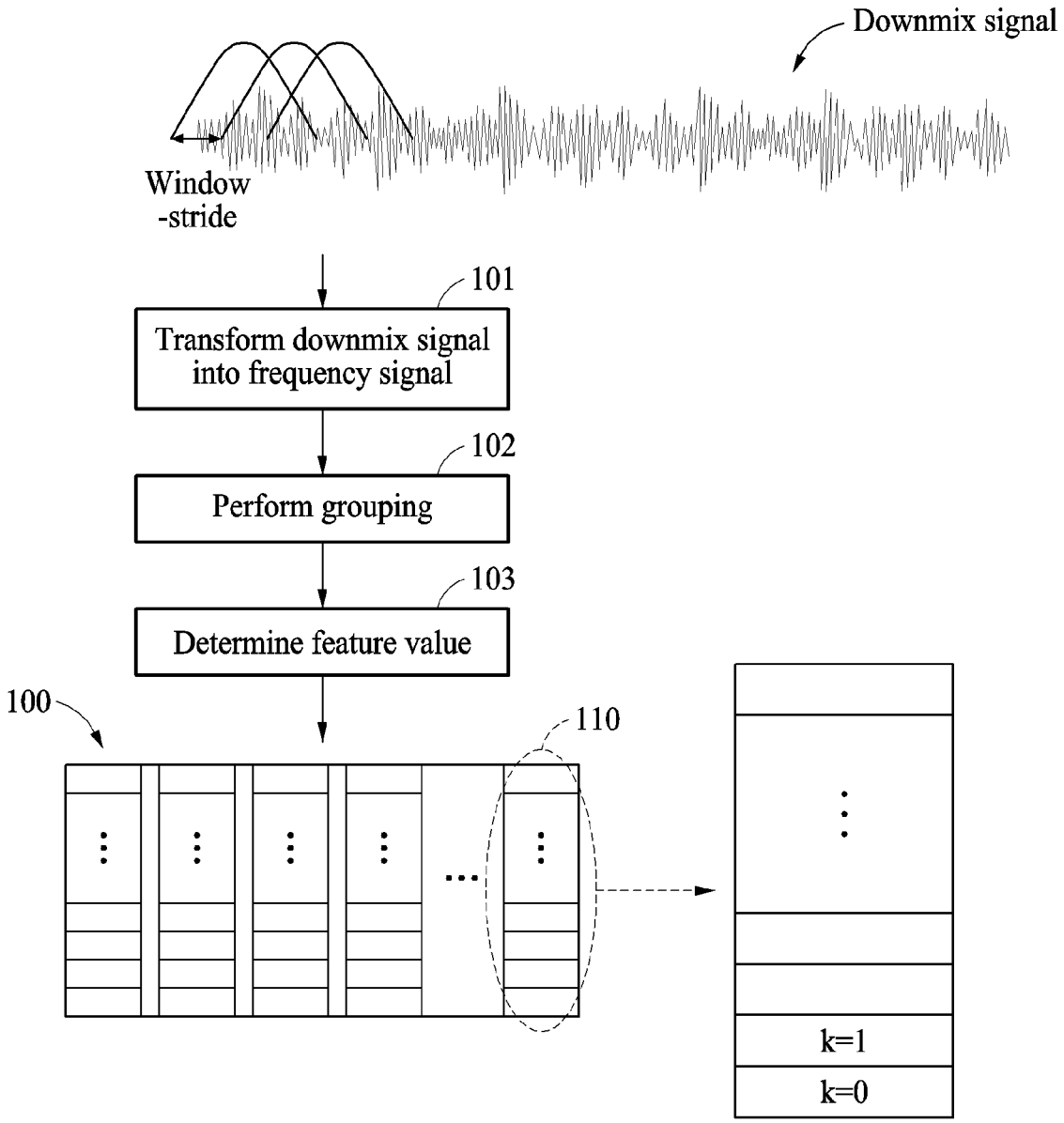
FIG. 1 is a diagram illustrating an example of a method of generating an input feature map from a downmix signal according to an example embodiment.

Throughout the drawings and the detailed description, unless otherwise described or provided, the same drawing reference numerals will be understood to refer to the same elements, features, and structures. The drawings may not be to scale, and the relative size, proportions, and depiction of elements in the drawings may be exaggerated for clarity, illustration, and convenience.

DETAILED DESCRIPTION

The following detailed description is provided to assist the reader in gaining a comprehensive understanding of the methods, apparatuses, and/or systems described herein. However, various changes, modifications, and equivalents of the methods, apparatuses, and/or systems described herein will be apparent after an understanding of the disclosure of this application. For example, the sequences of operations described herein are merely examples, and are not limited to those set forth herein, but may be changed as will be apparent after an understanding of the disclosure of this application, with the exception of operations necessarily occurring in a certain order. Also, descriptions of features that are known in the art may be omitted for increased clarity and conciseness.

The features described herein may be embodied in different forms, and are not to be construed as being limited to the examples described herein. Rather, the examples described herein have been provided merely to illustrate some of the many possible ways of implementing the methods, apparatuses, and/or systems described herein that will be apparent after an understanding of the disclosure of this application.

The terminology used herein is for describing various examples only, and is not to be used to limit the disclosure. The articles "a," "an," and "the" are intended to include the plural forms as well, unless the context clearly indicates otherwise. The terms "comprises," "includes," and "has" specify the presence of stated features, numbers, operations, members, elements, and/or combinations thereof, but do not preclude the presence or addition of one or more other features, numbers, operations, members, elements, and/or combinations thereof.

Although terms such as "first," "second," and "third" may be used herein to describe various members, components, regions, layers, or sections, these members, components, regions, layers, or sections are not to be limited by these terms. Rather, these terms are only used to distinguish one member, component, region, layer, or section from another member, component, region, layer, or section. Thus, a first member, component, region, layer, or section referred to in examples described herein may also be referred to as a second member, component, region, layer, or section without departing from the teachings of the examples.

Throughout the specification, when an element, such as a layer, region, or substrate, is described as being "on," "connected to," or "coupled to" another element, it may be directly "on," "connected to," or "coupled to" the other element, or there may be one or more other elements intervening therebetween. In contrast, when an element is described as being "directly on," "directly connected to," or "directly coupled to" another element, there can be no other elements intervening therebetween. As used herein, the term "and/or" includes any one and any combination of any two or more of the associated listed items.

Unless otherwise defined, all terms, including technical and scientific terms, used herein have the same meaning as commonly understood by one of ordinary skill in the art to which this disclosure pertains. Terms, such as those defined in commonly used dictionaries, are to be interpreted as having a meaning that is consistent with their meaning in the context of the relevant art, and are not to be interpreted in an idealized or overly formal sense unless expressly so defined herein.

According to an example embodiment, a device for predicting a channel parameter of an original signal from a downmix signal, hereinafter simply referred to as a channel parameter predicting device, may include a processor. The processor may determine an input feature map by determining a feature value of the downmix signal, and determine an output feature map including a predicted parameter to be used to predict the channel parameter of the original signal by applying the input feature map to a neural network. The processor may perform machine learning on the neural network by comparing the predicted parameter included in the output feature map and the channel parameter. Herein, the channel parameter may be a parameter indicating channel level information of the original signal, and the predicted parameter may be a predicted value of the channel parameter that is derived from the downmix signal.

FIG. 1 is a diagram illustrating an example of a method of generating an input feature map from a downmix signal according to an example embodiment.

Referring to FIG. 1, in operation 101, a processor of a channel parameter predicting device applies a window function to a downmix signal and transforms, into a frequency-domain signal, the downmix signal to which the window function is applied through a time-to-frequency (T/F) transformation method. Herein, various methods, for example, a fast Fourier transform (FFT), a discrete cosine transform (DCT), and a quadrature mirror filter (QMF) bank, may be used as the T/F transformation. The downmix signal to which the window function is applied may be extracted by being overlapped based on a window-stride value.

In operation 102, the processor classifies the transformed downmix signal, which may be represented by frequency coefficients, into a plurality of sub-groups each being in a sub-frame unit. For example, the coefficients in a frequency domain of the downmix signal in which a frame index is omitted may be represented by Equation 1.

$$X=[x(0), \ldots, x(k), \ldots, x(M-1)]^T \quad \text{[Equation 1]}$$

In Equation 1, M denotes a frame size, and the coefficients in the frequency domain of the downmix signal in which the frame index is omitted may be grouped as represented by Equation 2.

$$X=[x(0), \ldots, x(A_0-1), x(A_0) \ldots x(A_1-1), \ldots, x(A_{B-1}), \ldots, x(A_B)]^T$$

In Equation 2, B denotes the number of groups. The frequency coefficients may be grouped or classified into B groups, and each of the B groups may be defined as a sub-group.

In operation 103, the processor determines a feature value of each sub-group. The feature value may be a value corresponding to each of channels of the downmix signal, or a combination of the channels. For example, in a case in which there are three input signals including, for example, stereo and foreground, the feature value may be a power gain value of a left channel, a right channel, or a combination of the left channel, the right channel, and a foreground channel, or a correlation value of the signals. A power gain value for each sub-group may be obtained as represented by Equation 3.

$$P_b^{channel_index} = \sum_{k=A_{b-1}}^{A_b-1} x(k) \quad \text{[Equation 3]}$$

The feature value for each sub-group determined by the process may be stored for each frame, and be represented by a single map, for example, an input feature map 100 including a plurality of sub-groups 110. Herein, at least one input feature map may be present as the input feature map 100 based on a type of feature value. For example, in a case in which there are three input signals including, for example, stereo and foreground, five input feature maps may be present with respect to a feature value of each of a left channel, a right channel, a summation signal of the left channel and the right channel, a differential signal of the left channel and the right channel, and a signal indicating a correlation between the left channel and the right channel. A size of the input feature map 100 may be equal to a product of the number of sub-bands and the number of frames.

Figure 2:
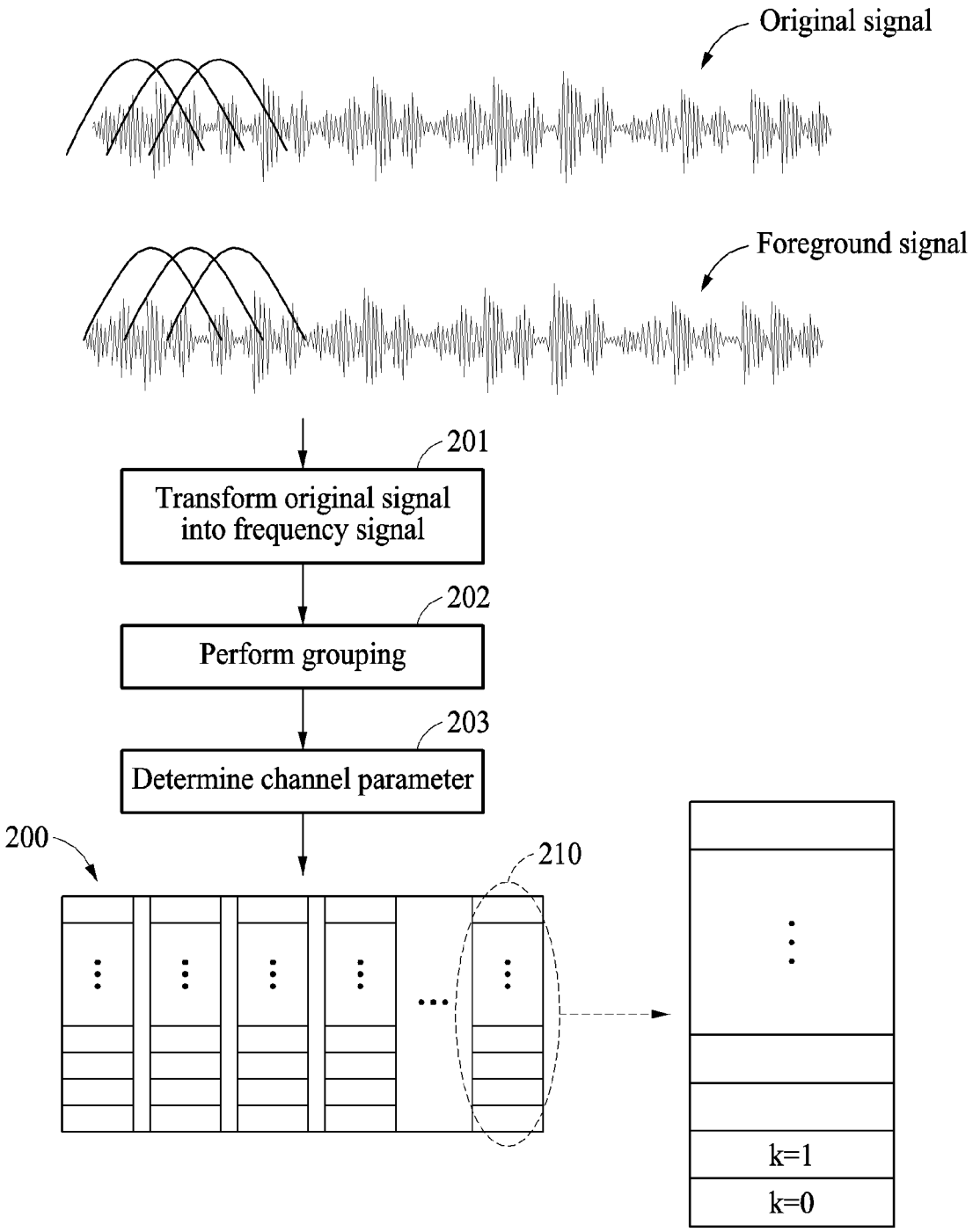
FIG. 2 is a diagram illustrating an example of a method of generating a label map from an original signal according to an example embodiment.

FIG. 2 is a diagram illustrating an example of a method of generating a label map from an original signal according to an example embodiment.

Referring to FIG. 2, in operation 201, a processor of a channel parameter predicting device applies a window function to an original signal and transforms, into a frequency-domain signal, the original signal to which the window function is applied through a T/F transformation method. The original signal to which the window function is applied may be extracted by being overlapped based on a window-stride value.

In operation 202, the processor classifies the transformed original signal, which may be represented by frequency coefficients, into a plurality of sub-groups each being in a sub-frame unit.

In operation 203, the processor determines a channel parameter for each sub-group. The channel parameter may be a value corresponding to a combination of channels of the original signal. For example, in a case in which there are three input signals including, for example, stereo and foreground, the channel parameter may be a channel level difference (CLD) or an inter-channel coherence (ICC) corresponding to a combination of a left channel and a foreground channel or a combination of a right channel and the foreground channel. The CLD for each sub-group may be obtained as represented by Equation 4.

$$CLD_{lc} = 10\log_{10}\left(\frac{P_b^l}{P_b^c}\right) \quad \text{[Equation 4]}$$

The ICC for each sub-group may be calculated as represented by Equation 5. In Equation 4, P denotes power for each sub-band b of the original signal.

$$ICC_b^{l_{org}c_f} = \quad \text{[Equation 5]}$$

-continued $$\sum_{k=A_{b-1}}^{A_b-1} \frac{\text{real}\,(l_{org}(k)(c_{forgroundd}(k))^*)}{\sqrt{l_{org}(k)(l_{org}(k))^* + c_{foreground}\,(k)(c_{foreground}(k))^*}}$$

The channel parameter for each sub-group determined by the processor may be stored for each frame, and be represented by a single map, for example, a label map 200 including a plurality of sub-groups 210. Herein, the label map 200 may be two types of label map, for example, a label map associated with a channel parameter generated from a left channel and a foreground channel, and a label map associated with a channel parameter generated from a right channel and the foreground channel. The processor may perform quantization on the determined channel parameter, for example, the CLD or the ICC. Herein, an input feature map or an output feature map may be quantized.

Figure 3:
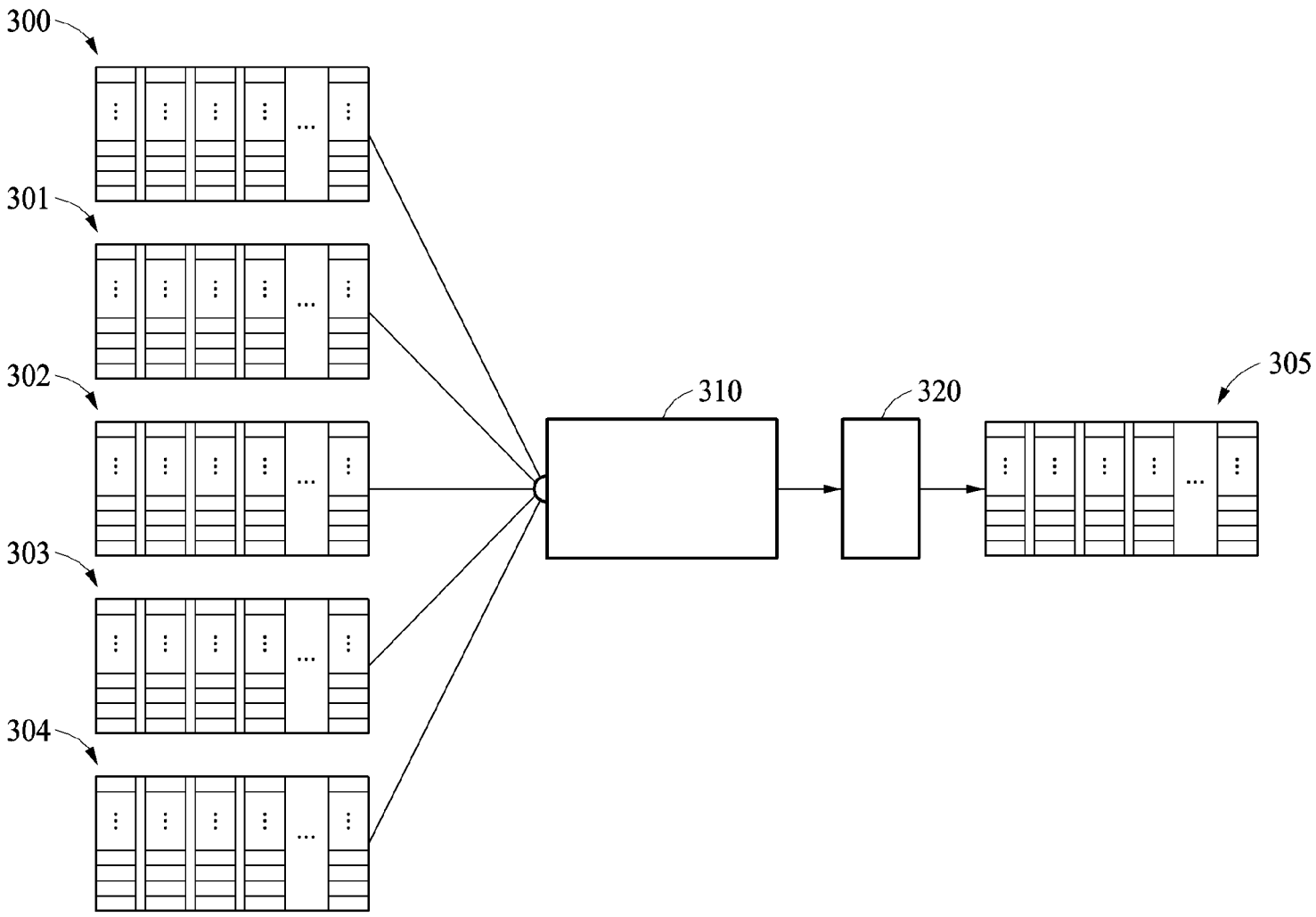
FIG. 3 is a diagram illustrating an example of a method of determining an output feature map from an input feature map according to an example embodiment.

FIG. 3 is a diagram illustrating an example of a method of determining an output feature map from an input feature map according to an example embodiment.

Referring to FIG. 3, a processor of a channel parameter predicting device applies, to a neural network 310, one or more input feature maps generated from a downmix signal, for example, input feature maps 300 through 304 as illustrated. The processor normalizes the input feature maps through a softmax function based on a quantization level of a label map, for example, the label map 200 of FIG. 2. The processor then determines an output feature map 305 including a predicted parameter of an original signal. In detail, as illustrated, the processor inputs the input feature maps 300 through 304 to the neural network 310. Herein, a convolutional neural network (CNN) may be used as an example of a neural network. The CNN may generate an output of the neural network from a filter and the number of filters. For example, a first layer of the neural network 310 may have an architecture of multiplication of F_L, F_R, and N_F, in which F_L and F_R indicate a filter size, and N_F indicates the number of feature maps. Such a single set of parameters, for example, F_L, F_R, and N_F, may be used to construct a single layer neural network, and the neural network may be expanded as a pooling method is used to reduce an output size and another layer is continuously added to the neural network. This is the same as an existing method of applying a CNN, and the present disclosure relates to a method of matching an input feature map and an output of a neural network.

A final end of the neural network 310 may be configured as a softmax 320. The number of output nodes of the softmax 320 may be determined based on the quantization level of the label map. Herein, a softmax is well-known technology that is used in a neural network, and has the number of output nodes corresponding to the number of classes to be determined. A softmax output node having a greatest value may be determined to be a class indicated by an index of the node. For example, when numerals 0 through 9 are to be determined, and training is performed by allocating correct answers to 0 through 9 in sequential order, the number of softmax nodes may be 10, and a position index of a node having a greatest value among output values may indicate a determined numerical value. Through the training, the neural network may be trained to reduce such an error.

For example, in a case in which the processor sets, to be 30, a quantization level for a channel parameter of the label map, an output of the softmax 320 for each sub-group of the output feature map 305 may have 30 nodes, among which one greatest node value may determine the quantization level in a test stage. Herein, the test stage may be a stage of operating a neural network with a neural network model for which training is completed, in response to a new input that is not used for the training, and of determining whether a result is the same as a correct answer and determining accuracy. For example, determining a correct answer by solving a problem for a new input may be training the neural network on a problem of discovering an index of a quantizer. A position of a node having a greatest index may be an index value of quantization as the correct answer. In this example, a quantization level indicated by the index may be used as an estimated value.

That is, the number of output nodes of the softmax 320 is equal to the product of the number of sub-groups of an output feature map and the quantization level, which is a value obtained by multiplication of the number of the sub-groups and the quantization level.

Figure 4:
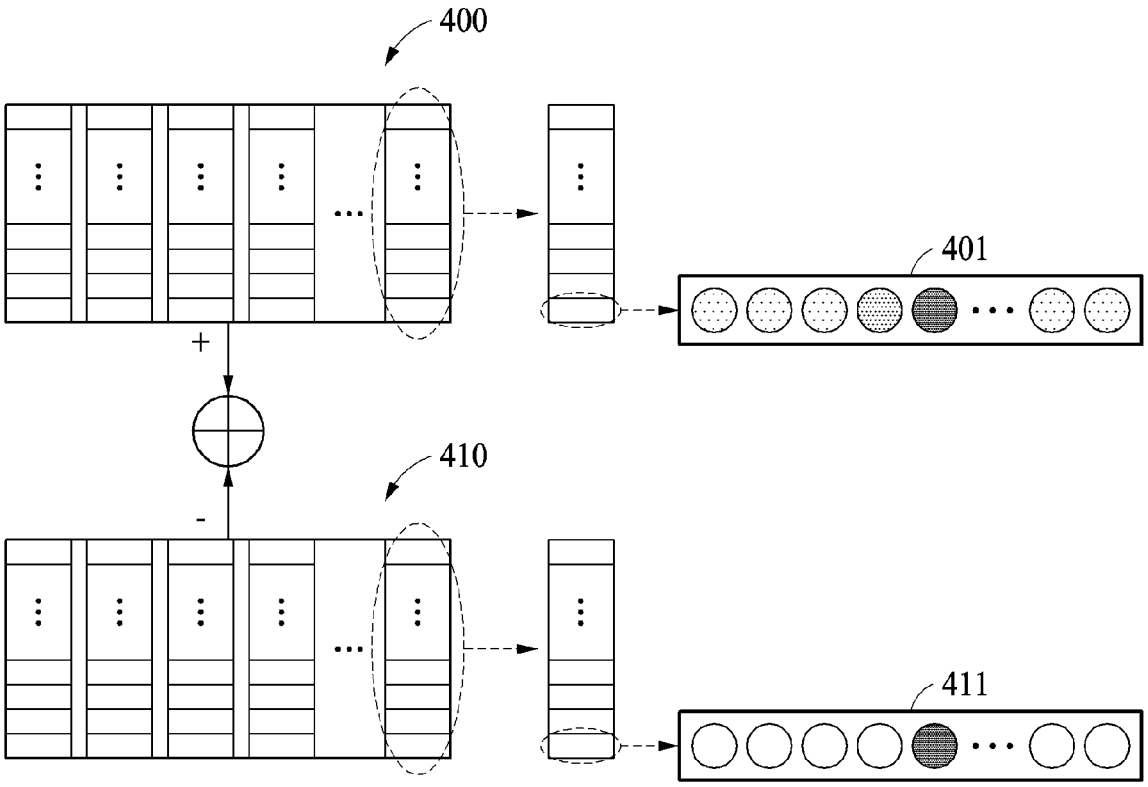
FIG. 4 is a diagram illustrating an example of a method of predicting a channel parameter by comparing an output feature map and a label map according to an example embodiment.

FIG. 4 is a diagram illustrating an example of a method of predicting a channel parameter by comparing an output feature map and a label map according to an example embodiment. As described above, to compare the output feature map and the label map, comparison of node positions of the output feature map and the label map may be performed. For example, in a case in which a position of a node of the output feature map and a position of a node of the label map are matched, it may be determined that a same quantization value is predicted and otherwise, it may be regarded as an error.

Figure 5:
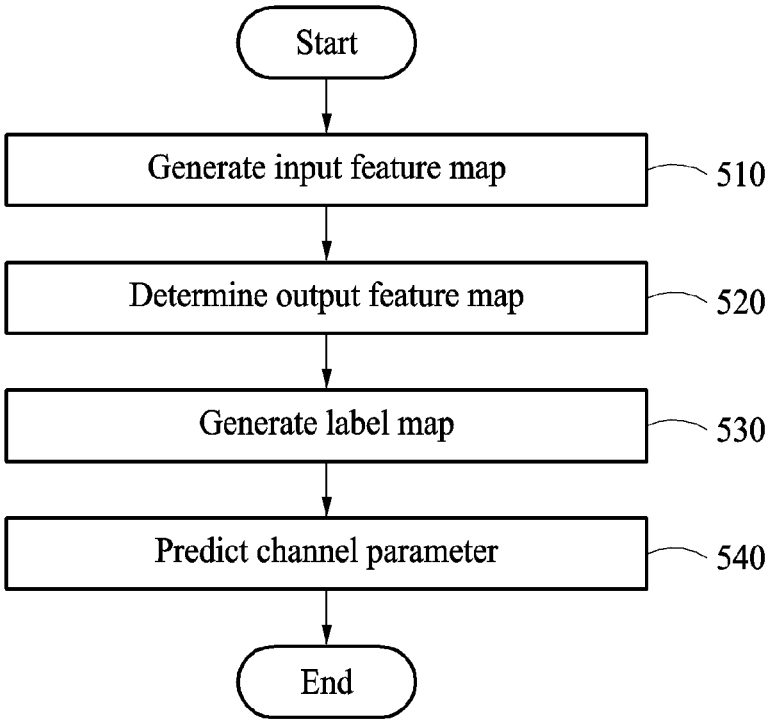
FIG. 5 is a flowchart illustrating an example of a method of predicting a channel parameter according to an example embodiment.

FIG. 5 is a flowchart illustrating an example of a method of predicting a channel parameter according to an example embodiment.

Referring to FIG. 5, in operation 510, a processor of a channel parameter predicting device generates an input feature map using a downmix signal.

In detail, the processor applies a window function to the downmix signal, and transforms the downmix signal to which the window function is applied into a frequency-domain signal. Herein, the downmix signal may be extracted by being overlapped based on a window-stride value. The processor classifies the transformed downmix signal into a plurality of sub-groups of a sub-frame unit, and then determines a feature value for each of the sub-groups. The feature value may be, for example, a power gain and a correlation of signals. The processor then stores the determined feature value for each frame of each sub-group, and generates the input feature map. Herein, the input feature map to be determined may be present as one or more input feature maps based on a type of feature value. For example, in a case in which there are three input signals including, for example, stereo and foreground, five input feature maps may be present, with a feature value of each of a left channel, a right channel, a summation signal of the left channel and the right channel, a differential signal of the left channel and the right channel, and a signal indicating a correlation between the left channel and the right channel.

In operation 520, the processor determines an output feature map that stores therein a predicted parameter of a channel parameter by applying the input feature map to a neural network and performing normalization through a softmax function.

In operation 530, the processor generates a label map that stores therein an output parameter using an original signal.

In detail, the processor applies a window function to the original signal, and transforms the original signal to which the window function is applied into a frequency-domain signal. The original signal may be extracted by being overlapped based on a window-stride value. The processor classifies the transformed original signal into a plurality of sub-groups in a sub-frame unit, and determines a channel parameter for each of the sub-groups. The channel parameter may be, for example, a CLD or an ICC. The processor then generates the label map by storing the determined channel parameter for each frame of each sub-group.

In operation 540, the processor determines whether the predicted parameter determined from the downmix signal corresponds to the channel parameter by comparing the output feature map and the label map, and trains the neural network based on a result of the determining. For the training, a final output end of the neural network may be configured as a softmax to determine a class, and the class may be a quantization index value of a parameter to be predicted. The training may be performed such that an error between the quantization index value, which is an actual correct answer, and a node value at a softmax output end is minimized. Thus, the number of output nodes of the softmax may be designed to be equal to the number of indices of a quantizer.

According to example embodiments described herein, by predicting a channel parameter of an original signal from a downmix signal through a machine learning-based algorithm, it is possible to improve a compression performance while maintaining a quality of an audio signal.

The components described in the example embodiments of the present disclosure may be achieved by hardware components including at least one of a digital signal processor (DSP), a processor, a controller, an application specific integrated circuit (ASIC), a programmable logic element such as a field programmable gate array (FPGA), other electronic devices, and combinations thereof. At least some of the functions or the processes described in the example embodiments of the present disclosure may be achieved by software, and the software may be recorded on a recording medium. The components, the functions, and the processes described in the example embodiments of the present disclosure may be achieved by a combination of hardware and software.

The processing device described herein may be implemented using hardware components, software components, and/or a combination thereof. For example, the processing device and the component described herein may be implemented using one or more general-purpose or special purpose computers, such as, for example, a processor, a controller and an arithmetic logic unit (ALU), a digital signal processor, a microcomputer, a field programmable gate array (FPGA), a programmable logic unit (PLU), a microprocessor, or any other device capable of responding to and executing instructions in a defined manner. The processing device may run an operating system (OS) and one or more software applications that run on the OS. The processing device also may access, store, manipulate, process, and create data in response to execution of the software. For purpose of simplicity, the description of a processing device is used as singular; however, one skilled in the art will be appreciated that a processing device may include multiple processing elements and/or multiple types of processing elements. For example, a processing device may include multiple processors or a processor and a controller. In addition, different processing configurations are possible, such as parallel processors.

The methods according to the above-described example embodiments may be recorded in non-transitory computer-readable media including program instructions to implement various operations of the above-described example embodiments. The media may also include, alone or in combination with the program instructions, data files, data structures, and the like. The program instructions recorded on the media may be those specially designed and constructed for the purposes of example embodiments, or they may be of the kind well-known and available to those having skill in the computer software arts. Examples of non-transitory computer-readable media include magnetic media such as hard disks, floppy disks, and magnetic tape; optical media such as CD-ROM discs, DVDs, and/or Blue-ray discs; magneto-optical media such as optical discs; and hardware devices that are specially configured to store and perform program instructions, such as read-only memory (ROM), random access memory (RAM), flash memory (e.g., USB flash drives, memory cards, memory sticks, etc.), and the like. Examples of program instructions include both machine code, such as produced by a compiler, and files containing higher level code that may be executed by the computer using an interpreter. The above-described devices may be configured to act as one or more software modules in order to perform the operations of the above-described example embodiments, or vice versa.

While this disclosure includes specific examples, it will be apparent to one of ordinary skill in the art that various changes in form and details may be made in these examples without departing from the spirit and scope of the claims and their equivalents. The examples described herein are to be considered in a descriptive sense only, and not for purposes of limitation. Descriptions of features or aspects in each example are to be considered as being applicable to similar features or aspects in other examples. Suitable results may be achieved if the described techniques are performed in a different order, and/or if components in a described system, architecture, device, or circuit are combined in a different manner and/or replaced or supplemented by other components or their equivalents. Therefore, the scope of the disclosure is defined not by the detailed description, but by the claims and their equivalents, and all variations within the scope of the claims and their equivalents are to be construed as being included in the disclosure.

What is claimed is:

1. A method of predicting a channel parameter of an original signal from a downmix signal, the method comprising:

generating an input feature map to be used to predict a channel parameter of the original signal based on a downmix signal of an original signal;

determining an output feature map including a predicted parameter to be used to predict the channel parameter by applying the input feature map to a neural network;

generating a label map including information associated with the channel parameter of the original signal; and predicting the channel parameter of the original signal by comparing the output feature map and the label map.

2. The method of claim 1, wherein the generating of the input feature map comprises:

transforming the downmix signal into a frequency-domain signal;

classifying the transformed downmix signal into a plurality of sub-groups; and determining a feature value corresponding to each of channels of the downmix signal or a combination of the channels for each of the sub-groups of the downmix signal.

3. The method of claim 2, wherein the combination of the channels is based on one of a summation, a differential, and a correlation of the channels.

4. The method of claim 1, wherein the generating of the label map comprises:

transforming the original signal into a frequency-domain signal;

classifying the transformed original signal into a plurality of sub-groups; and determining a channel parameter corresponding to a combination of channels of the original signal for each of the sub-groups.

5. The method of claim 1, wherein the determining of the output feature map comprises:

inputting the input feature map to the neural network; and normalizing the input feature map processed through the neural network based on a quantization level of the label map.

6. The method of claim 1, wherein the output feature map includes a predicted parameter corresponding to each of channels of the downmix signal or a combination of the channels.

7. A device for predicting a channel parameter of an original signal from a downmix signal, the device comprising:

a processor, wherein the processor is configured to:

generate an input feature map to be used to predict a channel parameter of the original signal based on a downmix signal of an original signal;

determine an output feature map including a predicted parameter to be used to predict the channel parameter by applying the input feature map to a neural network;

generate a label map including information associated with the channel parameter of the original signal; and predict the channel parameter of the original signal by comparing the output feature map and the label map.

8. The device of claim 7, wherein the processor is further configured to:

divide the downmix signal by frame unit;

transform the downmix signal into a frequency-domain signal;

classify the transformed downmix signal into a plurality of sub-groups; and determine a feature value corresponding to each of channels of the downmix signal or a combination of the channels for each of the sub-groups of the downmix signal.

9. The device of claim 8, wherein the combination of the channels is based on one of a summation, a differential, and a correlation of the channels.

10. The device of claim 7, wherein the processor is further configured to:

divide the original signal by frame unit;

transform the original signal into a frequency-domain signal;

classify the transformed original signal into a plurality of sub-groups; and determine a channel parameter corresponding to a combination of channels of the original signal for each of the sub-groups.

11. The device of claim 7, wherein the processor is further configured to:

input the input feature map to the neural network; and normalize the input feature map processed through the neural network based on a quantization level of the label map.

12. The device of claim 7, wherein the output feature map includes a predicted parameter corresponding to each of channels of the downmix signal or a combination of the channels.

* * * * *